United States Patent [19]

Collins

[11] 4,091,923

[45] May 30, 1978

[54] COMBINED CARTON AND SUPPORTING PALLET

[75] Inventor: Michael Alfred Collins, Coventry, England

[73] Assignee: Covpak International Limited, England

[21] Appl. No.: 669,258

[22] Filed: Mar. 22, 1976

[30] Foreign Application Priority Data

July 31, 1975 United Kingdom ..... 32148/75

[51] Int. Cl.[2] ..... B65D 19/06

[52] U.S. Cl. ..... 206/386; 108/51.3; 229/37 R

[58] Field of Search ..... 206/386; 108/51, 56, 108/51.3; 229/37 R

[56] References Cited

U.S. PATENT DOCUMENTS

| | | | |
|---|---|---|---|
| 1,708,700 | 4/1929 | Maier | 229/37 R |
| 1,847,598 | 3/1932 | Carnell | 229/37 R |
| 2,902,199 | 9/1959 | Breton | 206/386 |
| 3,601,067 | 8/1971 | Olsen | 108/51.3 |
| 3,831,744 | 8/1974 | Walden et al. | 206/386 |
| 3,881,429 | 5/1975 | Seymore | 108/51.3 |
| 3,949,874 | 4/1976 | Heavner | 206/386 |

*Primary Examiner*—Herbert F. Ross
*Attorney, Agent, or Firm*—Gifford, Chandler, VanOphem, Sheridan & Sprinkle

[57] ABSTRACT

A combined carton and supporting pallet therefor in which the carton is formed from a sheet of cardboard or like foldable sheet material and has four walls, which, in use, are upright and have flaps at their upper and lower edges, the flaps being foldable inwardly on erection of the carton to form respectively the top and bottom surfaces of the carton. The pallet is formed from a base and a floor hinged to the base along one edge thereof and foldable to lie flat on top of the base. The base and the floor are formed from a sheet of cardboard or like foldable sheet material and each have the same plan form as the carton, when erected. The carton and the pallet are retained together by so folding the flaps on the lower edges of the walls of the carton that, referring to the carton when upright, one pair of the flaps on one pair of opposite walls of the carton are positioned above the floor of the pallet and the other pair of the flaps on the other pair of opposite walls are folded underneath the floor and are held between the floor and the base of the pallet by the weight of the carton, and, when the carton has been packed, also by its contents.

10 Claims, 5 Drawing Figures

COMBINED CARTON AND SUPPORTING PALLET

FIELD OF THE INVENTION

The invention is concerned with a carton and supporting pallet therefor which prior to assembly can be stacked flat, except possibly for feet by which the pallet is to rest on the ground, the carton and the pallet, except possibly the pallet feet, being foldable from cardboard or like foldable sheet material.

DESCRIPTION OF THE PRIOR ART

It is known from U.S. Pat. No. 2,902,199 issued Sept. 1, 1959 to Breton to make a pallet separately from a carton which is to be erected on the pallet. In Breton the erected carton is secured to the pallet by interposing flaps on the pallet between pairs of flaps forming the base of the carton and folded inwardly from the side and end walls of the carton. That arrangement is only possible when using a pallet having flaps of comparatively thin cardboard which are flexible because one at least of the flaps on the pallet must be bent in insert the flaps on the pallet into the bottom of the carton.

SUMMARY OF THE INVENTION

The invention provides a combined carton and supporting pallet therefor in which the carton is formed from a sheet of cardboard or like foldable sheet material and has four walls, which, in use, are upright and have flaps at their upper and lower edges, the flaps being foldable inwardly on erection of the carton to form respectively the top and bottom surfaces thereof, and the pallet comprises a base and a floor hinged to the base along one edge thereof, whereby the floor is foldable to lie flat on top of the base, the base and the floor being formed from a sheet of cardboard or like foldable sheet material and each having the same plan-form as the carton, when erected, the carton and the pallet being retained together, in use, by so folding the flaps on the lower edges of the walls of the carton that, referring to the carton when upright, one pair of the flaps on one pair of opposite walls are positioned above the floor and the other pair of the flaps on the other pair of opposite walls are folded underneath the floor and are held between the floor and the base of the pallet by the weight of the carton, and, when the carton has been packed, also by its contents.

Conveniently, hinges provided between the floor and the pallet base and between said other lower flaps and the respective carton walls are each formed by parallel fold-lines spaced apart by a distance greater than the combined thickness of the sheets from which the carton and the floor and pallet base are folded, thereby to permit the aforesaid folding of the floor and said other flaps respectively.

To reduce the quantity of sheet material used and to avoid unnecessary thickness at the bottom of the carton, the carton flaps adjacent the bottom end of the carton (referring to the carton when erected and upright) each have a length, measured from the fold-line or outer fold-line thereof to the parallel free edge of the flap, which is less than half the respective length or width of the carton, as viewed in plan, whereby said carton flaps form only marginal portions of the bottom of the carton, the remainder of the bottom of the carton being defined by said floor.

The invention also includes separately a blank from which the carton of the combined carton and pallet, as aforesaid, is formed, and the pallet therefor, the pallet also having feet depending from the underneath surface of the base to support the base above the ground. The feet also provide access for the insertion thereunder of straps for further securing the carton to the pallet or for a lifting fork. The feet may be so arranged that access for a lifting fork may be achieved at any of the four edges of the pallet.

The invention also provides the method of erecting the aforesaid combined carton and pallet, the method consisting in the steps of erecting the walls of the carton, folding the upper flaps inwardly of the walls to form the top of the carton, placing the carton top downward on the ground, folding said one pair of lower flaps to extend horizontally inwardly from the respective walls, placing the pallet, with the floor face downward, on said folded one pair of lower flaps, folding said other pair of lower flaps to overlie the floor, folding the base of the pallet to lie inverted on top of said other pair of lower flaps and the floor, and finally turning-over the assembled pallet and carton so that the pallet rests on the ground and the carton is upright on the pallet.

BRIEF DESCRIPTION OF THE DRAWINGS

By way of example a combined carton and pallet in accordance with the invention is now described with reference to the accompanying drawings, in which.

DESCRIPTION OF THE PREFERRED EMBODIMENT

Figures 1, 2:
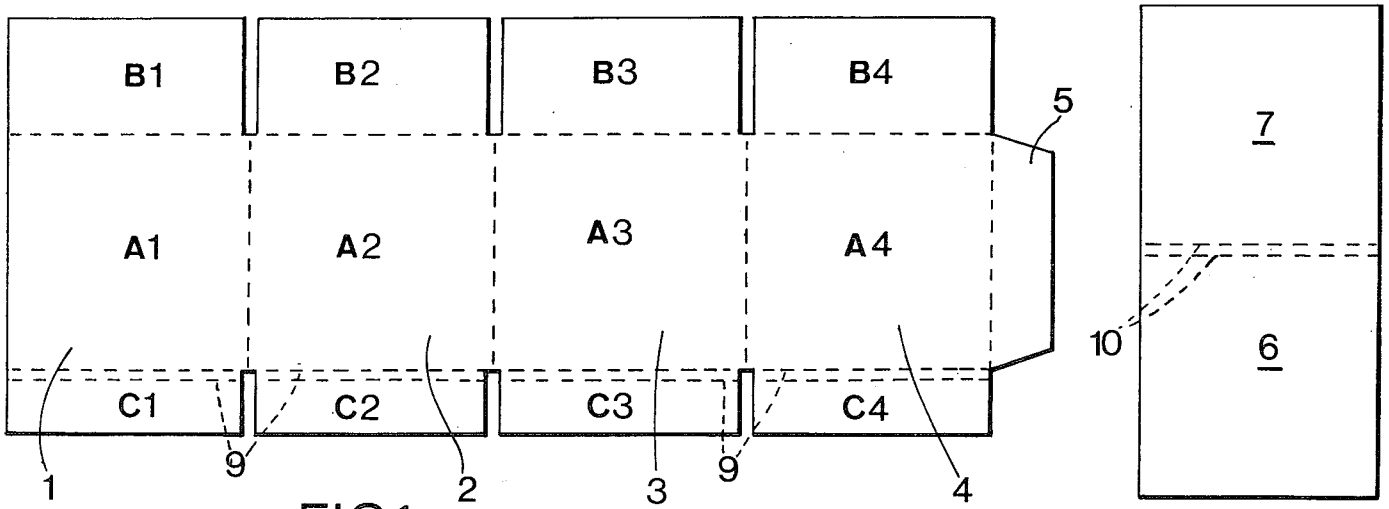
FIG. 1 is an elevation of the blank from which the carton is formed.
FIG. 2 is an elevation of the blank from which the pallet is formed.

The carton is folded in conventional manner from the blank of cardboard or other sheet material shown in FIG. 1. The blank consists of four panels 1, 2, 3 and 4, each having three regions which will form in the erected carton a wall $A_1$, $A_2$, $A_3$ and $A_4$; a top flap $B_1$, $B_2$, $B_3$ and $B_4$ and a bottom flap $C_1$, $C_2$, $C_3$ and $C_4$ respectively. The wall portion $A_4$ of panel 4 is formed with an integral flange 5 which is stitched or stapled, inside the outer edge of the wall portion $A_1$ of panel 1. Thus the blank is erected in known manner to form a carton, the flaps being folded inwardly of the walls to form the top and bottom of the carton. Unlike a conventional carton, the flaps $C_1$, $C_2$, $C_3$ and $C_4$ are shorter than the flaps $B_1$, $B_2$, $B_3$ and $B_4$ and therefore do not completely close the bottom of the carton. The reason for this will be apparent later.

The pallet is shown in FIG. 2 and is formed from two hinged portions providing a base 6 and a floor 7 which is foldable along its hinge to lie on the base 6. The base 6 and the floor 7 are of substantially the same size and shape as the plan-form of the carton, when erected. The base has feet 8 (see FIGS. 3 to 5) attached to its normally lower face 6. The feet 8 will be described in greater detail later.

Further features of the carton and pallet will be described during the description of the assembly which now follows with reference to FIGS. 3 to 5.

Figure 3:
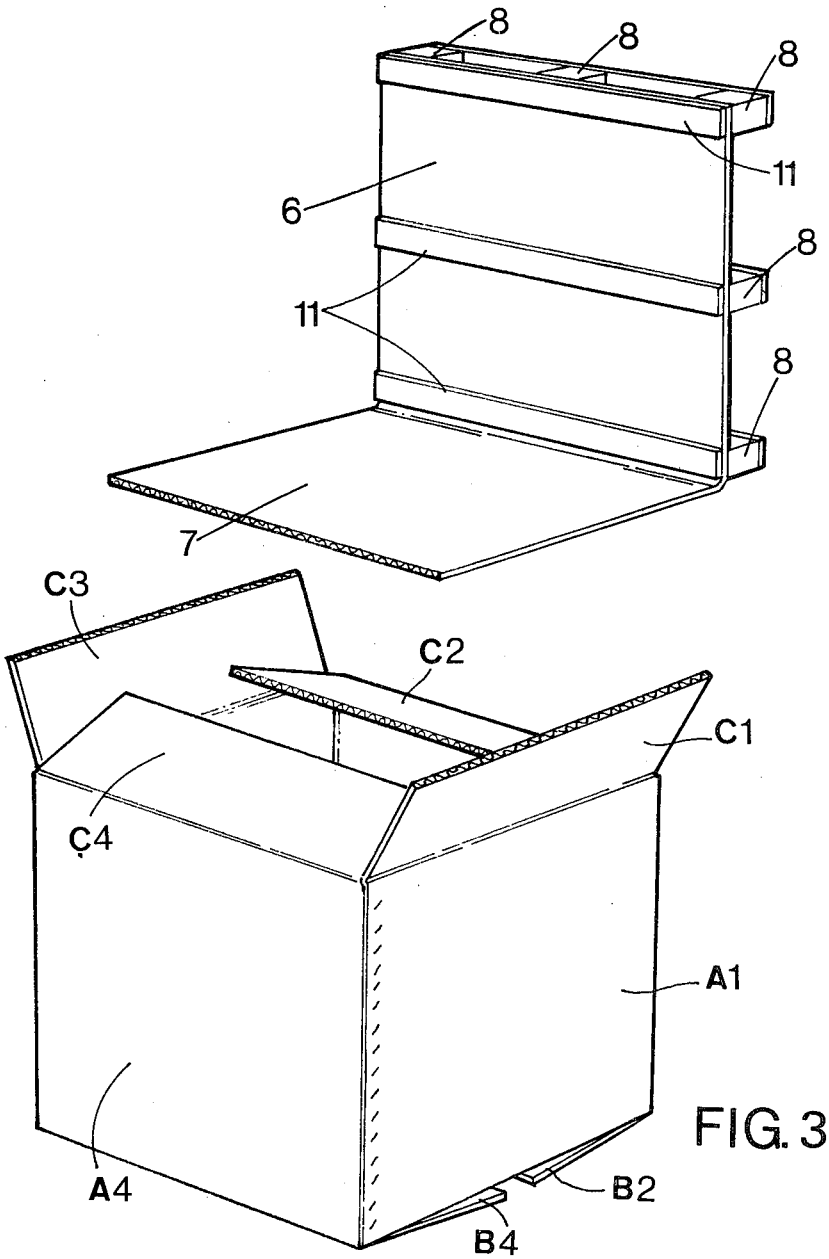
FIGS. 3 to 5 are perspective views showing successive stages in the assembly of the combined carton and pallet.

As shown in FIG. 3, the carton is erected, the top flaps $B_1$, $B_2$, $B_3$ and $B_4$ only being folded, thereby to close the top of the carton. The carton is then placed upside down on a flat surface. The bottom flaps $C_2$ and $C_4$ are folded inwardly and then the floor 7 of the pallet is placed upper face downwardly, on those flaps.

Figure 4:
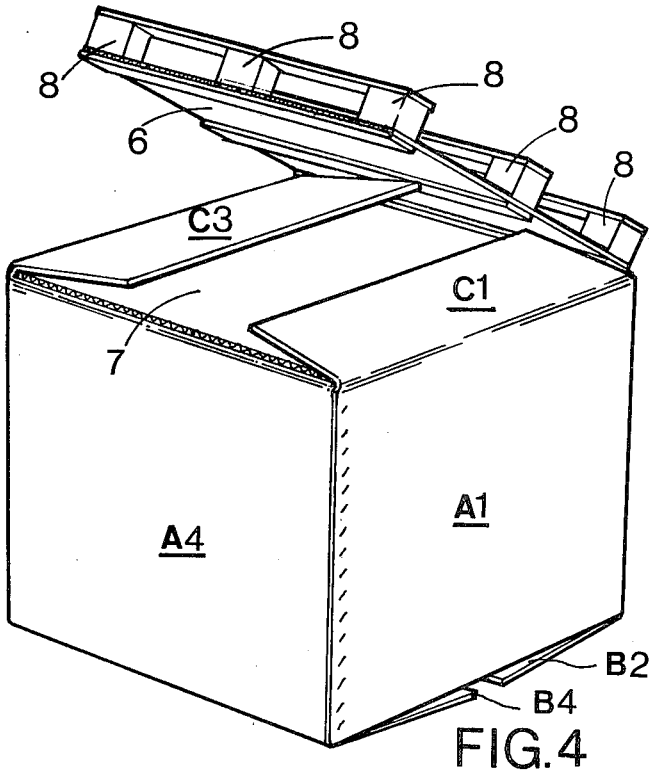

Referring now to FIG. 4, the bottom flaps $C_1$ and $C_3$ are then folded to lie on the floor 7.

The hinges between the wall portion $A_1$ and the bottom flap $C_1$ and between the wall portion $A_3$ and the bottom flap $C_3$ are each formed by parallel fold-lines 9 spaced apart by a distance greater than the combined thickness of the sheets from which the carton and the pallet are formed, thereby to permit the bottom flaps $C_1$ and $C_3$ to be folded flat over the bottom flaps $C_2$ and $C_4$ and the floor 7. As shown in FIG. 1, the bottom flaps $C_2$ and $C_4$ are for convenience similarly hinged.

The base 6 is then folded flat on top of the bottom flaps $C_2$ and $C_4$ and the floor 7.

The hinge between the floor 7 and the base 6 is formed by parallel fold-lines 10 (see FIG. 2) spaced apart by a distance greater than the combined thickness of the sheets from which the carton and the pallet are formed, thereby to permit the base 6 to be folded flat on to the bottom $C_1$ and $C_3$ and the floor 7.

Figure 5:
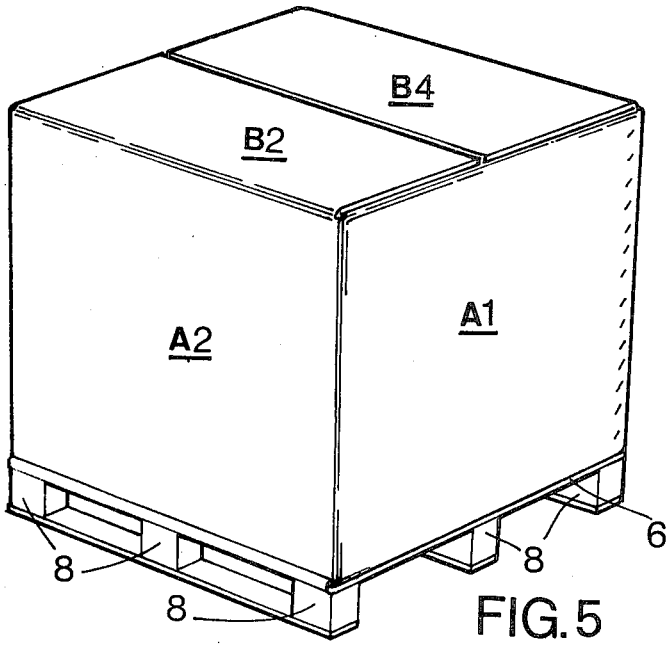

The assembled carton and pallet is then turned-over to the position shown in FIG. 5, in which the weight of the carton holds the carton firmly on the pallet and the pallet firmly to the carton. When the carton is filled, the weight of the contents hold the carton and the pallet together even more securely.

There are two reasons for making the bottom flaps $C_1$, $C_2$, $C_3$ and $C_4$ shorter than the top flaps $B_1$, $B_2$, $B_3$ and $B_4$. The first is to save the use of cardboard and the second is to reduce the total thickness of the central region of the bottom of the combined carton and pallet from four thicknesses of cardboard to two, namely the floor 7 and the base 6 only.

The term cardboard as used herein includes flat cardboard sheet or laminated plane and corrugated sheets.

Finally, reference is made to the feet. These are formed by nine blocks 8 spaced apart in three rows along all four edges and the centre of the underneath face of the base to permit the forks of a fork-lift truck to be inserted between adjacent rows of blocks from any one of the four edges of the base 6. The blocks 8 also serve to raise the base of the pallet from the ground or from a lower carton on which it is stacked. They also enable straps to be inserted around the pallet and the carton.

The blocks 8 may be permanently attached to the base 6 or they may be inserted into cardboard sleeves integral with or secured to the underneath surface of the base 6 and extending parallel to the plane of the base 6. This latter arrangement enables the pallet blanks to be stacked completely flat by collapsing the sleeves when the blocks 8 are not inserted therein. The blocks 8 may be of wood or of other suitable material, e.g., polyurethane foam. The blocks 8 or the cardboard sleeves may be secured through the base 6 to stiffening strips 11 of cardboard or wood or other stiff sheet material, the base 6 being gripped between the strips 11 and the blocks 8 or sleeves by securing means such as staples or rivets. Alternatively the strips 11 may simply be stiffening strips secured to the base 6 by glueing or by staples or other securing means.

What I claim as my invention and desire to secure by Letters Patent of the United States is:

1. A combined carton and supporting pallet therefor in which the carton is formed from thick, stiff cardboard, and has four walls, which, in use, are upright and flaps at the upper and lower edges of each said wall, said flaps being foldable inwardly on erection of said carton to form respectively the top and bottom surfaces thereof, and the pallet comprises a base and a one-piece inflexible floor hinged to the base along only one edge thereof, whereby the floor is hinged to lie flat on top of the base, the edges of said base and said floor, other than the hinged edges, being coextensive and free edges, the base and the floor being formed from thick, stiff inflexible cardboard, and each having the same plan-form and area as said carton, when erected, the carton and the pallet being retained together, in use, by so folding said flaps on the lower edges of the walls of said carton that, referring to the carton when upright, one pair of said flaps on one pair of opposite walls of said carton are positioned above the floor and the other pair of said flaps on the other pair of opposite walls are folded underneath the floor and are held between the floor and the base of the pallet by the weight of said carton, and, when the carton has been packed, also by its contents.

2. A combined carton and supporting pallet therefor as claimed in claim 1 in which hinges provided between the floor and the base of said pallet and between said other lower flaps and the respective carton walls are each formed by parallel fold-lines spaced apart by a distance greater than the combined thickness of the sheets from which the carton and the floor and the base of said pallet are folded, thereby to permit the aforesaid folding of the floor and said other flaps respectively.

3. A combined carton and supporting pallet therefor as claimed in claim 1 in which the carton flaps adjacent the bottom end of the carton (referring to the carton when erected and upright) each have a length, measured from the fold-line or outer fold-line thereof to the parallel free edge of the flap, which is less than half the respective length or width of the carton, as viewed in plan, whereby said carton flaps form only marginal portions of the bottom of the carton, the remainder of the bottom of the carton being defined by said floor.

4. A combined carton and supporting pallet therefor as claimed in claim 1 in which the pallet also has feet depending from the underneath surface of the base to support the base above the ground, in the erected and assembled condition of the carton and pallet.

5. A combined carton and supporting pallet therefor as claimed in claim 4 in which said feet are formed from collapsible open-ended sleeves secured to the underneath surface of the base of the pallet, the sleeves extending parallel to the plane of the base of the pallet and being held open in use by removable blocks inserted through the sleeves.

6. A combined carton and supporting pallet therefor as claimed in claim 4 in which the feet are spaced apart in rows parallel to and along edges of the pallet base.

7. A combined carton and supporting pallet therefor as claimed in claim 6 in which there are nine feet spaced apart in three parallel rows and are located along all four edges and at the centre of the pallet base.

8. The method of erecting a combined carton and pallet therefor according to claim 1, the method consisting in the steps of erecting the walls of the carton, folding said upper flaps inwardly of the walls to form the top of the carton, placing the carton top downward on a supporting surface folding said one pair of lower flaps to extend horizontally inwardly from the respective walls, placing the pallet, with the flexible floor thereof face downward, on said folded one pair of lower flaps, folding said other pair of lower flaps to overlie said floor, folding the base of the pallet to lie inverted on top of said other pair of lower flaps and said floor, and finally turning-over the assembled pallet and carton so that the pallet rests on said supporting surface and the carton is upright on the pallet.

9. The method according to claim 8 of erecting a combined carton and pallet having feet depending from the base for support, said feet formed from collapsible open-ended sleeves secured to the underneath surface of the base of the pallet, the sleeves extending parallel to the plane of the base of the pallet and being held open in use by removable blocks inserted through the sleeves, including the additional steps of erecting said open-ended sleeves forming the feet and inserting blocks through the erected sleeves.

10. A combined carton and supporting pallet therefor in which the carton is formed from a sheet of thick, stiff cardboard and has four walls, which, in use, are upright and each have flaps at their upper and lower edges, the flaps being foldable inwardly on erection of the carton to form respectively the top and bottom surfaces thereof, and the pallet comprises a base and a one-piece inflexible floor hinged along one edge to one edge of the base, the edges of said base and said floor, other than the hinged edges, being coextensive and free edges, whereby the floor is hinged to lie flat on top of the base, the base and the floor being formed from thick, stiff inflexible cardboard and each, when assembled with the erected carton, having the same plan-form and area as the carton, the carton and the pallet being retained together, in use, by so folding the flaps on the lower edges of the walls of the carton that, referring to the carton when upright, the lower flaps on one pair of opposite walls are folded underneath the floor and are held between the floor and the base of the pallet by the weight of the carton, and, when the carton has been packed, also by its contents, the lower end flaps of the carton each having a depth, measured from the fold-line thereof to the parallel free edge of the flap of less than half the respective length or width of the carton, as viewed in plan.

* * * * *

UNITED STATES PATENT AND TRADEMARK OFFICE

CERTIFICATE OF CORRECTION

PATENT NO. : 4,091,923

DATED : May 30,1978

INVENTOR(S) : MICHAEL ALFRED COLLINS

It is certified that error appears in the above-identified patent and that said Letters Patent are hereby corrected as shown below:

Col. 4, line 67, delete "flexible" and insert --inflexible-- therefor.

Signed and Sealed this

*Thirty-first* Day of *October 1978*

[SEAL]

*Attest:*

RUTH C. MASON
*Attesting Officer*

DONALD W. BANNER
*Commissioner of Patents and Trademarks*